US007168368B1

(12) United States Patent
Warner et al.

(10) Patent No.: US 7,168,368 B1
(45) Date of Patent: Jan. 30, 2007

(54) APPARATUS FOR EXPELLING A PAYLOAD FROM A WARHEAD

(75) Inventors: Brad H. Warner, Alexandria, VA (US); Thomas J. Gebhard, Waldorf, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 448 days.

(21) Appl. No.: 10/843,650

(22) Filed: May 6, 2004

(51) Int. Cl.
*F42B 12/58* (2006.01)

(52) U.S. Cl. ..... 102/489; 102/357; 102/393

(58) Field of Classification Search ..... 102/489, 102/357, 393, 340, 351
See application file for complete search history.

(56) References Cited

U.S. PATENT DOCUMENTS 3,981,244 A 9/1976 Adimari et al. ..... 102/489
4,226,185 A 10/1980 Tobler et al. ..... 102/340
4,342,262 A * 8/1982 Romer et al. ..... 102/489
4,488,489 A * 12/1984 Schoffl ..... 102/489
4,712,482 A * 12/1987 Bock et al. ..... 102/501
5,000,095 A * 3/1991 Rieger et al. ..... 102/489
H959 H * 9/1991 Heckman et al. ..... 102/489
5,210,372 A 5/1993 Tripptrap et al. ..... 102/489
5,287,810 A * 2/1994 Aumasson et al. ..... 102/489
5,317,975 A 6/1994 Sauvestre et al. ..... 102/489
5,398,615 A * 3/1995 Johnsson et al. ..... 102/489

* cited by examiner

*Primary Examiner*—Michelle Clement
(74) *Attorney, Agent, or Firm*—Fredric J. Zimmerman

(57) ABSTRACT

Apparatus within a warhead for expelling a payload from the rear of the warhead after a tail assembly has been removed. A separate thrust chamber within the warhead has an apertured thrust tube at one end which extends into the thrust chamber and a pusher plate at the other end for propelling the payload. The thrust chamber includes a propellant which, when ignited generates high pressure gas causing a rocket effect out the thrust tube to move the pusher plate and associated payload. The pusher plate may be disconnected from the thrust chamber to slow the expulsion process.

8 Claims, 5 Drawing Sheets

APPARATUS FOR EXPELLING A PAYLOAD FROM A WARHEAD

STATEMENT OF GOVERNMENT INTEREST

The invention described herein may be manufactured and used by or for the Government of the United States of America for government purposes without the payment of any royalties therefor.

BACKGROUND OF THE INVENTION

Various scenarios require that a payload be expelled from the rear of a falling warhead at some point in its trajectory, and after a tail section connected to the warhead has been jettisoned, or otherwise removed. Systems for accomplishing this include the use of a parachute stored in the warhead and operable to deploy the payload. Such arrangement may take up too much space and may be impractical for some missions since the parachute takes an objectionably long time to fully deploy.

In another arrangement, the interior of the warhead includes a propellant charge which when activated produces high pressure gas and propels the payload away from the warhead. In order not to exceed the burst pressure of the warhead, the warhead must be made thicker, thus adding to its weight. Additionally, some warheads have one or more apertures in the sidewall for fuzing hardware. Gas driving the payload can escape though these holes and thereby reduce the length over which the gas is effective in propelling the payload.

It is a primary object of the present invention to provide a payload expelling arrangement which obviates the problems associated with current designs.

SUMMARY OF THE INVENTION

Apparatus for expelling a payload out the rear of a warhead having a nose portion and a body portion with a cylindrical interior wall includes a thrust chamber positioned within the warhead and a thrust tube, having a plurality of apertures, connected at one end of the thrust chamber and extending into said thrust chamber. A pusher plate is connected to the thrust chamber at an opposite end thereof. A payload is positioned to be ejected from the interior of the warhead by the pusher plate. A propellant material is contained within the thrust chamber and an arrangement is provided for igniting the propellant to generate high pressure gas which expels out the thrust tube via the apertures. The pusher plate may be selectively disconnected from the thrust chamber so as to vary the exit velocity of the payload.

BRIEF DESCRIPTION OF THE DRAWINGS

The invention will be better understood, and further objects, features and advantages thereof will become more apparent from the following description of the preferred embodiment, taken in conjunction with the accompanying drawings, in which.

DETAILED DESCRIPTION OF THE PREFERRED EMBODIMENTS

Figure 1:
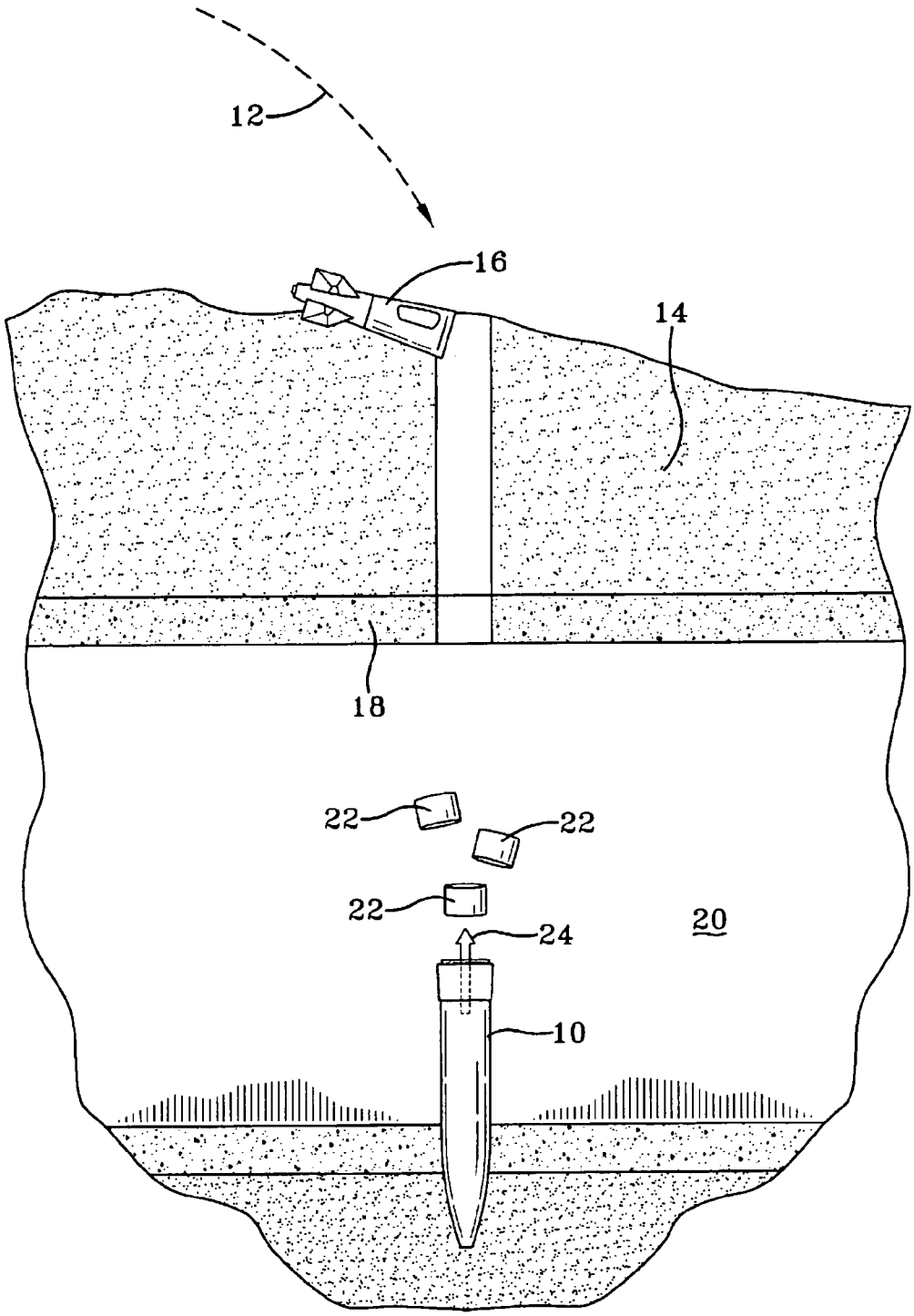
FIG. 1 illustrates one scenario in which a payload is expelled from a bomb.

In the drawings, which are not necessarily to scale, like or corresponding parts are denoted by like or corresponding reference numerals.

In the scenario of FIG. 1, the warhead portion 10 of a penetrating bomb, following a trajectory 12, has penetrated through soil 14 causing the tail section 16 of the bomb to be removed. The warhead 10 additionally penetrates through a reinforcement 18 into an open space 20 where a payload is to be delivered. When a sensor system carried by the warhead 10 senses a lack of penetration resistance a payload expulsion unit ejects a payload 22 out the rear of the warhead 10, as indicated by arrow 24, and which payload may consist of one or more components.

Figure 2:
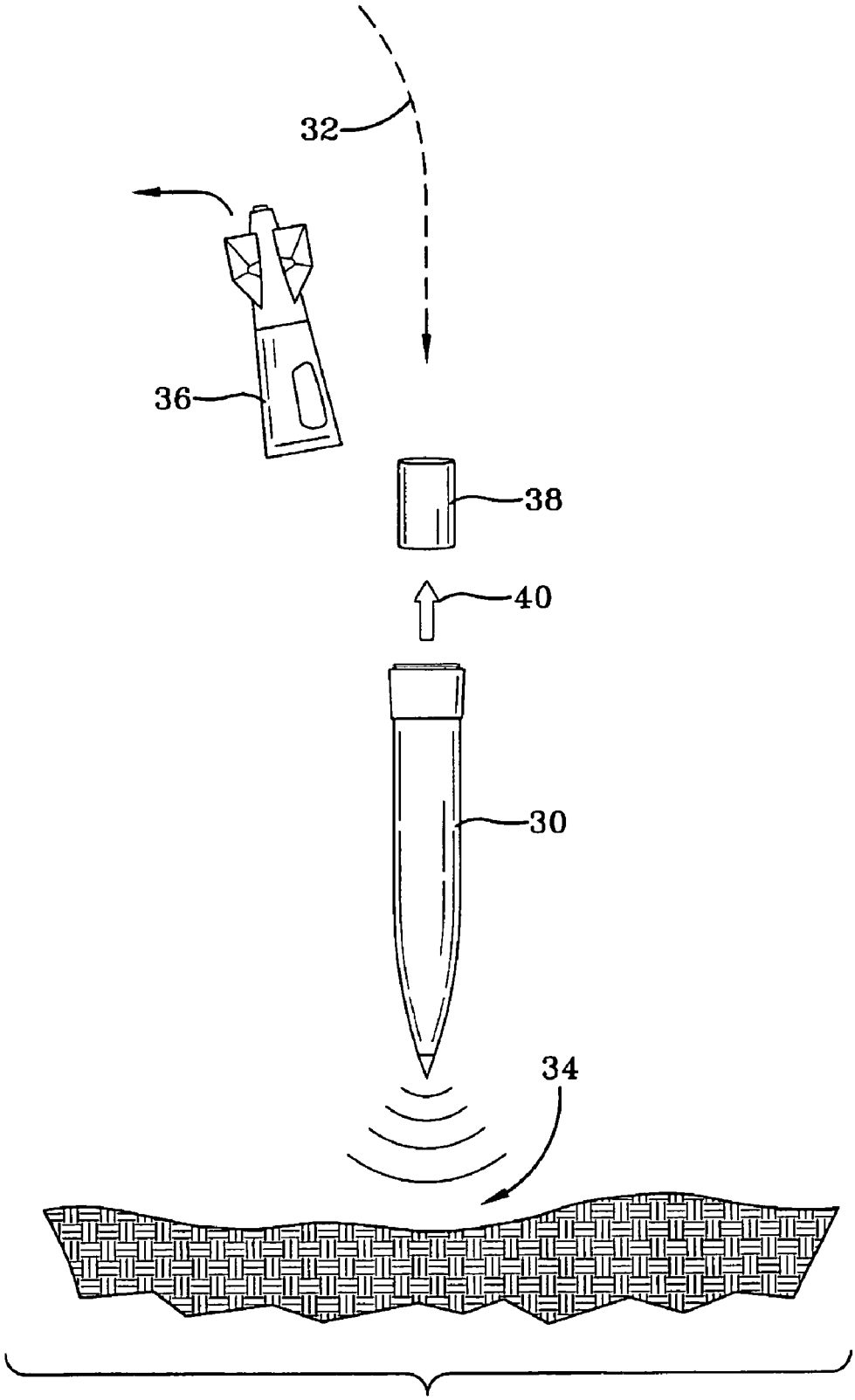
FIG. 2 illustrates another such scenario.

In FIG. 2, a warhead 30 of a proximity bomb following trajectory 32 is above a target area 34 to which a payload is to be delivered. When a warhead-carried proximity system detects that the warhead 30 is at a predetermined height above target area 34, the tail section 36 of the bomb is jettisoned, allowing a payload expulsion unit to eject the payload 38 out the rear of the warhead 30, as indicated by the arrow 40.

Figure 3:
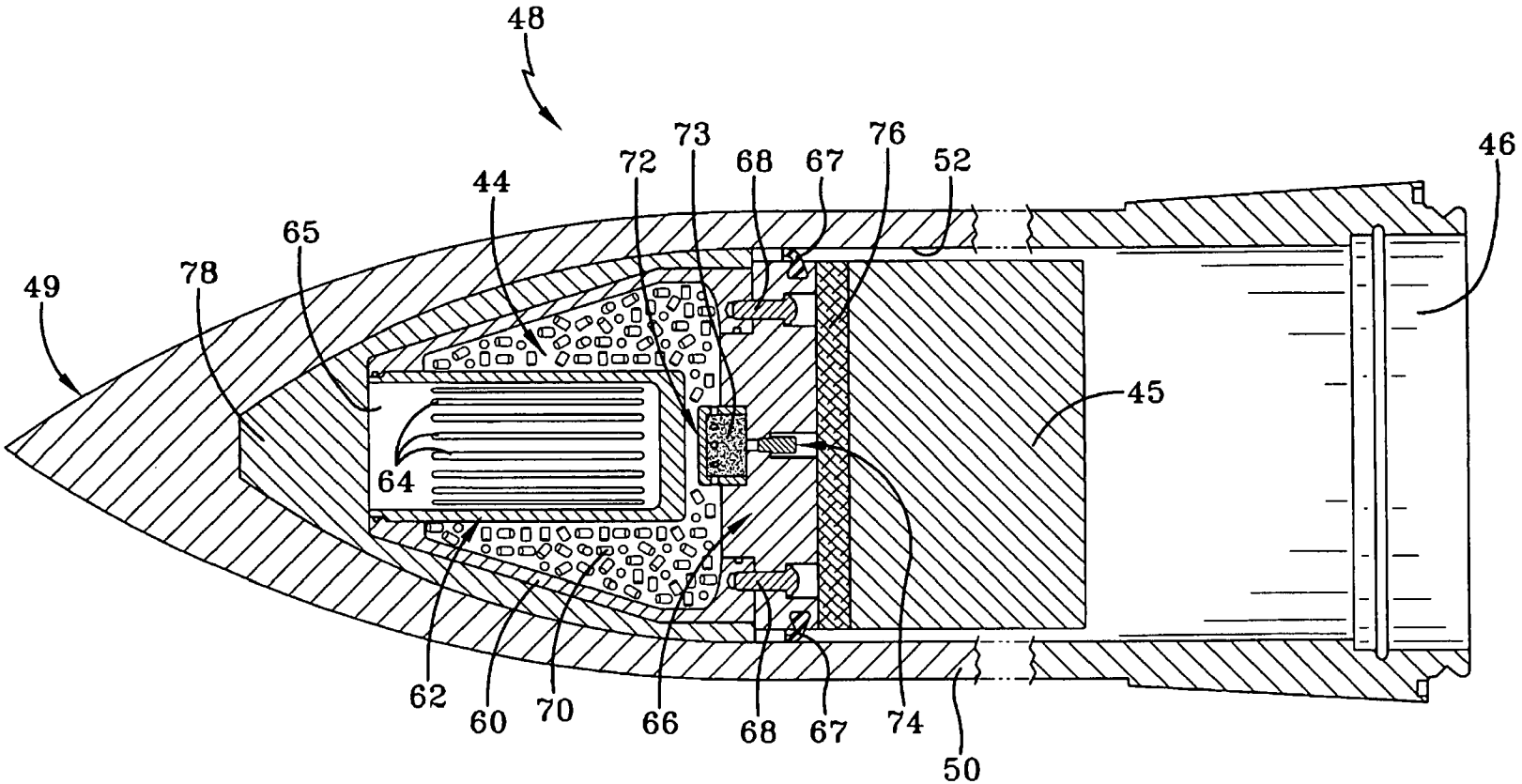
FIG. 3 illustrates, in cross sectional view, an embodiment of the invention, prior to activation.

In the embodiment of the invention illustrated in FIG. 3, expulsion apparatus 44 is operable to propel a payload 45 out the open rear end 46 of a warhead 48 having a nose portion 49 and a body portion 50 defining a cylindrical inner wall 52. Prior to the payload expulsion, a tail assembly (not shown) connected to the rear 46 will have been jettisoned.

The expulsion apparatus 44 includes a thrust chamber 60 having at one end, a thrust tube 62 which extends into the interior of the thrust chamber 60, with thrust tube 62 including a plurality of apertures such as longitudinal slots 64. The total area of the apertures 64 is greater than the gas exit 65 area of the thrust tube 62. The other, and open end of thrust chamber 60 is closed off by a piston or pusher plate 66 detachably connected to the thrust chamber 60 by means of explosive bolts 68, by way of example, and including a peripheral seal 67 which contacts the cylindrical inner wall 52 during travel of the pusher plate 66. Thrust chamber 60 is filled with a propellant 70 such as energetic granules of a size sufficiently large so as to be contained in the thrust chamber 60 by the slotted thrust tube 62.

Propellant 70 is activated by an igniter 72 attached to pusher plate 66 and filled with a charge 73 set off by an electric initiator 74. The signal for initiating this action is derived from a fuzing and control section 76, located, by way of example, between the pusher plate 66 and payload 45. This fuzing and control section 76 may also be used to activate the explosive bolts 68, or other like device, to cause separation of the pusher plate 66 with the thrust chamber 60 in response, for example, to a predetermined time after propellant 70 ignition or in response to a predetermined achieved velocity. The thrust chamber 60 rests on a liner 78 in the nose portion 49 until such time that the payload 45 is to be ejected, as in FIG. 1 or 2.

Figure 4:
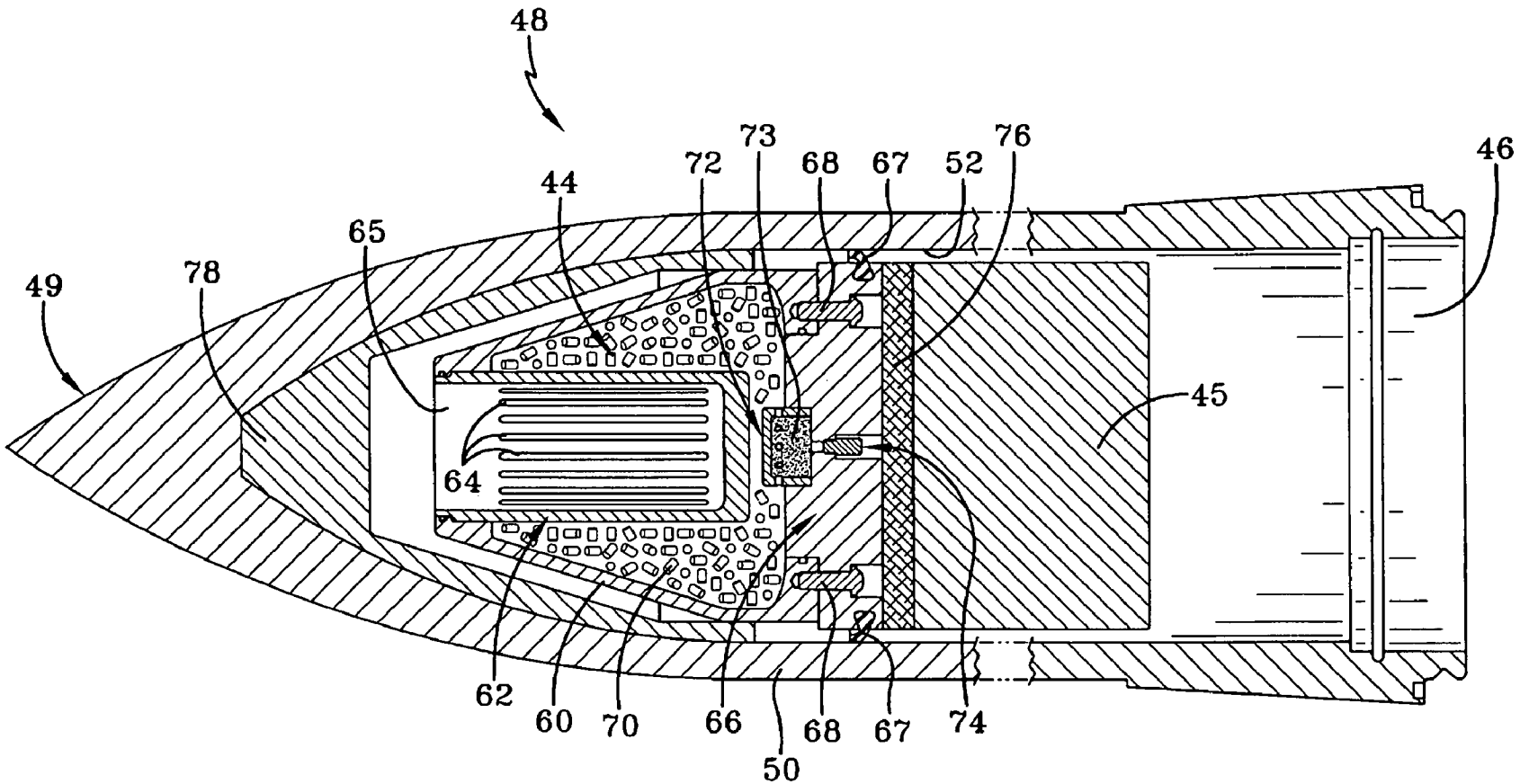
FIG. 4 illustrates, in cross sectional view, the embodiment just after activation.

When the times comes for payload ejection, fuzing and control section 76 sends a signal to initiator 74 to set off the charge 73 in igniter 72. This in turn ignites propellant 70 in thrust chamber 60 and the resulting high pressure gas generated exits through slots 64 in thrust tube 62 to the lower pressure interior of warhead 48. Gas exiting from thrust tube 62 initiates movement of thrust chamber 60, pusher plate 66 and payload 45, as indicated in FIG. 4 where the thrust chamber 60 has separated from liner 78. The fact that the propellant 70 is contained in a separate thrust chamber 60, lowers the pressure burden on the warhead casing and establishes an effectively fixed burn volume, allowing less propellant to be used and leading to faster payload ejection velocities. Once the thrust chamber 60 is past the liner 78, ejection will also be aided by pressure on seal 67, although the pressure will be lower than the gas pressure in thrust tube 62.

Figure 5:
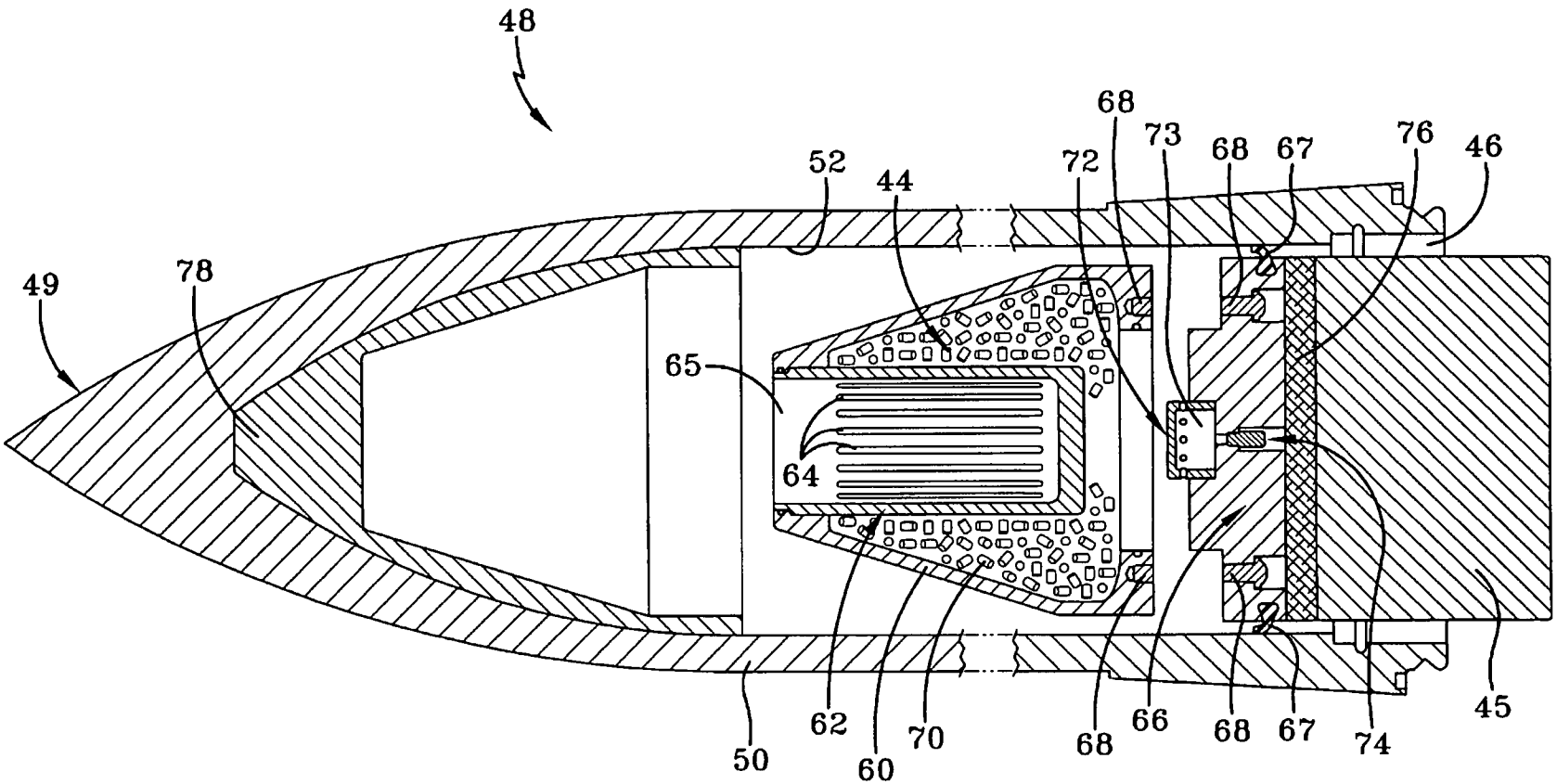
FIG. 5 illustrates a separation action between two components in the ejection process.

If it desired to slow down the ejection velocity, and as indicated in FIG. 5, a signal from fuzing and control section 76 causes the release mechanism, illustrated by the explosive bolts 68, to separate the thrust chamber 60 from pusher plate 66, thus allowing gas resulting from propellant 70 to be vented from thrust chamber 60 through its now open end, which was previously closed by pusher plate 68. This action essentially causes the propellant 70 to burn at a slower rate, thereby supplying less energy to the expulsion process and the payload ejects at a lower velocity than without the separation.

It will be readily seen by one of ordinary skill in the art that the present invention fulfills all of the objects set forth herein. After reading the foregoing specification, one of ordinary skill in the art will be able to effect various changes, substitutions of equivalents and various other aspects of the present invention as broadly disclosed herein. It is therefore intended that the protection granted hereon be limited only by the definition contained in the appended claims and equivalents. Having thus shown and described what is at present considered to be the preferred embodiment of the present invention, it should be noted that the same has been made by way of illustration and not limitation. Accordingly, all modifications, alterations and changes coming within the spirit and scope of the present invention are herein meant to be included.

What is claimed is:

1. Apparatus for expelling a payload out the rear of a warhead having a nose portion and a body portion with a cylindrical interior wall, comprising:

a thrust chamber positioned within said warhead;

a thrust tube having a plurality of apertures, and a gas exit, and being connected at one end of said thrust chamber and extending into said thrust chamber;

a pusher plate connected to said thrust chamber at an opposite end thereof;

a payload positioned to be ejected from the interior of said warhead by said pusher plate;

a propellant material within said thrust chamber; and an igniter adjacent said propellant material for igniting said propellant material to generate high pressure gas which expels out said gas exit of said thrust tube via said apertures;

wherein the total area of said apertures is greater than said gas exit area of said thrust tube.

2. Apparatus according to claim 1 wherein:

said opposite end of said thrust chamber is open and is closed off by said pusher plate.

3. Apparatus according to claim 2 which includes:

a release mechanism connecting said thrust chamber with said pusher plate and operable to allow separation of said thrust chamber and said pusher plate in response to a predetermined signal.

4. Apparatus according to claim 3 wherein:

said release mechanism is a plurality of explosive bolts.

5. Apparatus according to claim 1 which includes:

a seal surrounding said pusher plate and contacting said cylindrical interior wall of said body portion.

6. Apparatus according to claim 1 wherein:

said apertures in said thrust tube are longitudinal slots.

7. Apparatus according to claim 1 which includes:

a liner positioned in said nose portion;

said thrust chamber initially abutting said liner prior to a said payload expulsion.

8. Apparatus according to claim 1 wherein:

said igniter is carried by said pusher plate to initiate ignition of said propellant material.

* * * * *